US007803009B2

(12) United States Patent
Su et al.

(10) Patent No.: US 7,803,009 B2
(45) Date of Patent: Sep. 28, 2010

(54) PLUG CONNECTOR WITH IMPROVED CABLE ARRANGEMENT AND CONVENIENT ASSEMBLY

(75) Inventors: Ping-Sheng Su, Tu-Cheng (TW); Hong-Lei Fan, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/499,663

(22) Filed: Jul. 8, 2009

(65) Prior Publication Data

US 2010/0009569 A1 Jan. 14, 2010

(30) Foreign Application Priority Data

Jul. 8, 2008 (CN) ..... 2008 1 0302574

(51) Int. Cl.
*H01R 12/24* (2006.01)

(52) U.S. Cl. ..... 439/492

(58) Field of Classification Search ..... 439/498, 439/497, 637, 502, 353, 492
See application file for complete search history.

(56) References Cited

U.S. PATENT DOCUMENTS 6,695,641 B1 * 2/2004 Lee ..... 439/493
6,824,426 B1 * 11/2004 Spink, Jr. ..... 439/579
7,083,465 B2 * 8/2006 Wu ..... 439/497
7,134,908 B2 * 11/2006 Wu ..... 439/502
7,553,191 B2 * 6/2009 Su et al. ..... 439/637
7,585,184 B2 * 9/2009 Su et al. ..... 439/579
7,708,587 B2 * 5/2010 Wu ..... 439/492
2006/0079119 A1 * 4/2006 Wu ..... 439/492

* cited by examiner

*Primary Examiner*—Chandrika Prasad
(74) *Attorney, Agent, or Firm*—Wei Te Chung; Andrew C. Cheng; Ming Chieh Chang

(57) ABSTRACT

A plug connector (100) includes an insulative housing (1) including a base portion (10) and a mating portion (12) extending from the base portion in a first mating direction, a number of contacts (2) received in the insulative housing, a circuit board (6) with a plurality of through holes (620) therein, and a number of wires (3) comprising a number of signal wires (31) and a number of power wires (32) respectively electrically connecting with the contacts. The contacts comprise a number of signal contacts (23) and a number of power contacts (21), the signal contacts are soldered with the circuit board. The signal wires are flatly soldered on the circuit board, the power wires are soldered with the contacts directly or electrically connected with the contacts by the circuit board. The signal wires are arranged to extend laterally along a second direction perpendicular to a first mating direction, the power wires are arranged to extend along a third direction perpendicular to the second direction.

14 Claims, 10 Drawing Sheets

PLUG CONNECTOR WITH IMPROVED CABLE ARRANGEMENT AND CONVENIENT ASSEMBLY

BACKGROUND OF THE INVENTION

1. Field of the Invention

The present invention generally relates to a plug connector, and more particularly to a plug connector in accordance with SAS (Serial Attached SCSI; Serial Attached Small Computer System Interface) or Serial ATA standard.

2. Description of Related Art

Computers are widely used in different fields today. Each computer is equipped a hard disk drive (HDD) for storing data. When the computer work, a Central Processing Unit (CPU) thereof continuously accesses the hard disk drive to retrieve data from the hard disk or store data to the hard disk drive. For compatibility, the interfaces of the hard disk drive are standardized. There is at least two or three existing standards, typically the SCSI (Small Computer System Interface) and ATA (Advanced Technology Attachment) standards in the last decade.

Serial Attached SCSI is developed from parallel SCSI. Besides the advantages of higher signal transmission speed, the most important advantage is that SAS interface is compatible with SATA interface. That is to say, if the system permits, the plug connector with SATA interface can be plugged into the socket connector with SAS interface. The SAS receptacle connector generally has the same configuration as the SATA receptacle connector except that the two cavities of the SATA receptacle connector are merged in a single, but larger one, and a third set of signal contacts are incorporated into a second side wall opposing a first side wall where two sets of contacts have already being assembled.

CN patent No. 201018142Y issued to Su on Feb. 6, 2008 discloses a plug connector in accordance with SAS standard. The plug connector comprises signal wires and power wires parallel to each other, the signal wires electrically connect with a plurality of signal contacts, and tail portions thereof are arranged vertically to a mating direction with the end, so that the signal wires can extend along a direction perpendicular to the mating direction.

CN patent No. 2624453Y issued to Liu on Jul. 7, 2004 discloses another plug connector in accordance with Serial ATA interface. The plug connector comprises a plurality of signal wires extending along a direction vertical to a mating portion with bending the signal wires adjacent to contacts of the plug connector. However, the inner space in the case of a server or PC is decreased gradually with the development of electronics; thus, particular cable arrangement manner is needed to satisfy the current demands. In some cases, the arrangement of the signal and power wires stated above cannot meet the requirements. In addition, such manner of bending the contacts or the wires is inconvenient in assembly.

Correspondingly, it is desired to have a plug connector with improved cable arrangement and convenient assembly to address the problems stated above.

BRIEF SUMMARY OF THE INVENTION

Accordingly, an object of the present invention is to provide a plug connector with improved cable arrangement for convenient assembly and use.

In order to achieve the above-mentioned object, a plug connector in accordance with the present invention comprises an insulative housing including a base portion and a mating portion extending from the base portion in a first mating direction, a number of contacts received in the insulative housing, a circuit board with a plurality of through holes therein, and a number of wires comprising a number of signal wires and a number of power wires respectively electrically connecting with the contacts. The contacts comprise a number of signal contacts and a number of power contacts, the signal contacts are soldered with the circuit board. The signal wires are flatly soldered on the circuit board, the power wires are soldered with the contacts directly or electrically connected with the contacts by the circuit board. The signal wires are arranged to extend laterally along a second direction perpendicular to a first mating direction, the power wires are arranged to extend along a third direction perpendicular to the second direction.

Other objects, advantages and novel features of the invention will become more apparent from the following detailed description of the present embodiment when taken in conjunction with the accompanying drawings.

DETAILED DESCRIPTION OF THE INVENTION

Figure 1:
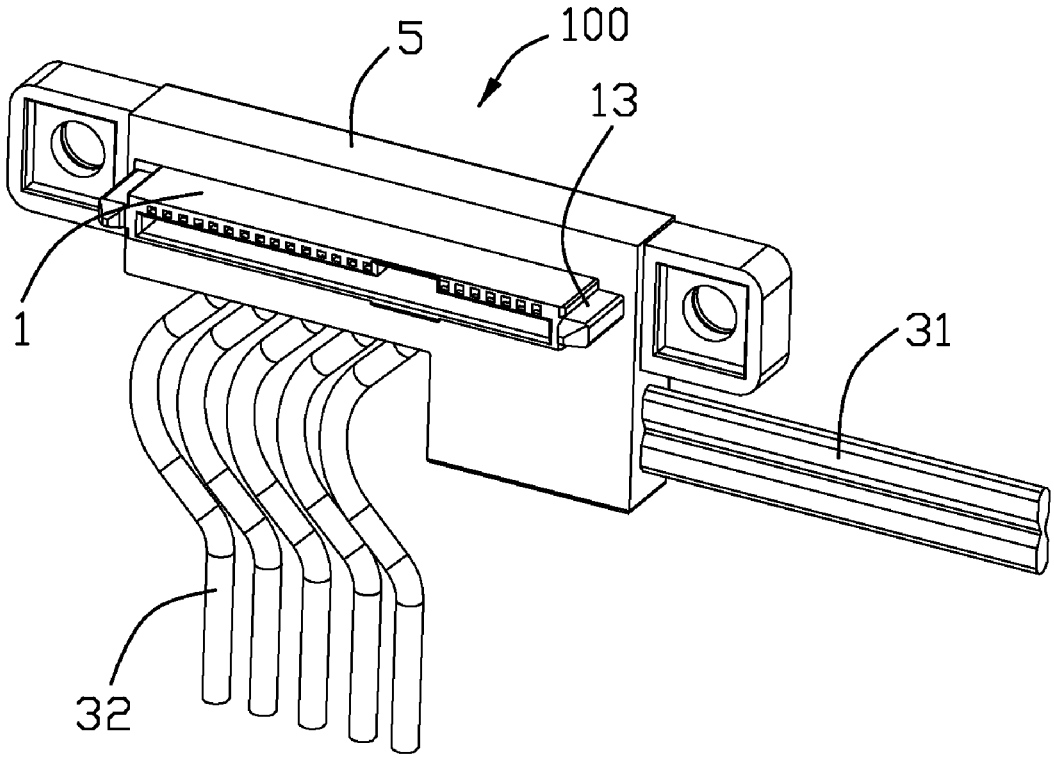
FIG. 1 is an assembled, perspective view of a plug connector of the first embodiment in accordance with the present invention.
Figure 2:
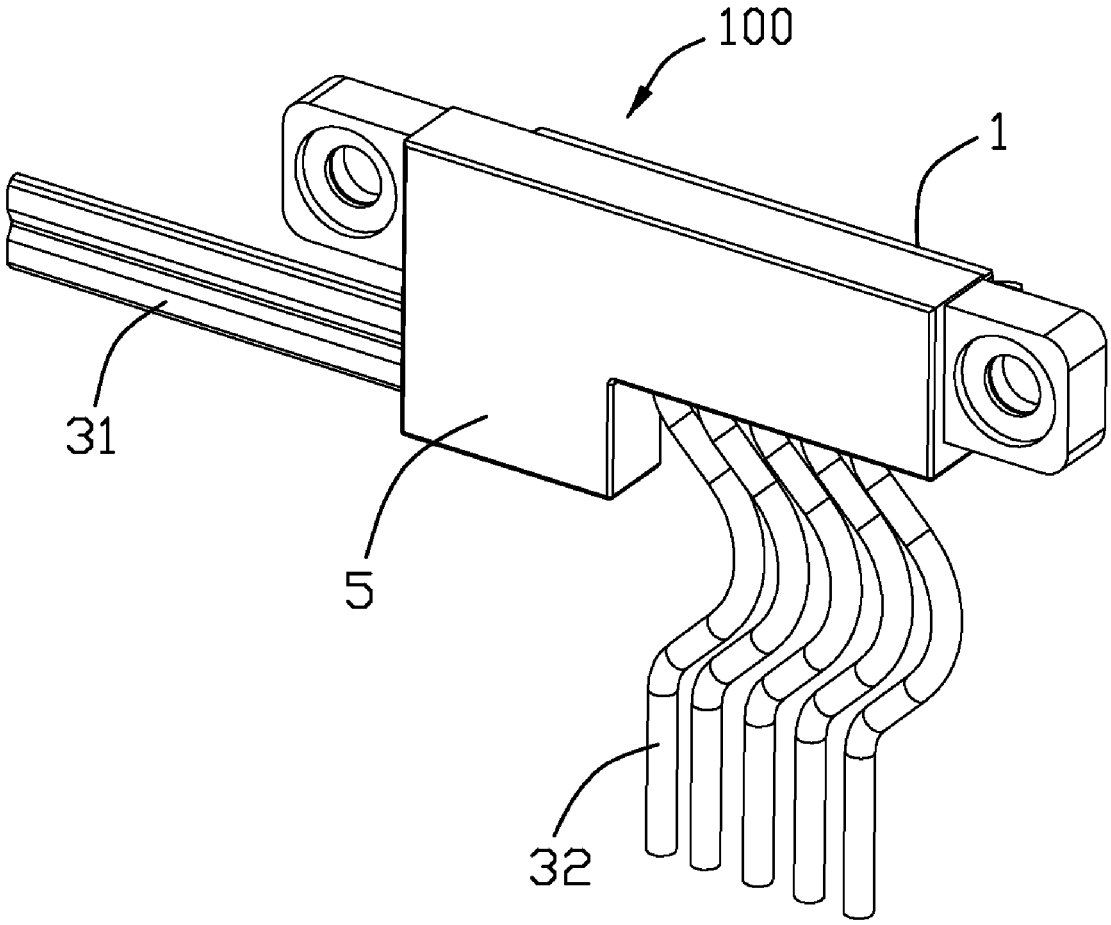
FIG. 2 is a view similar to FIG. 1, but viewed from a different aspect.
Figure 3:
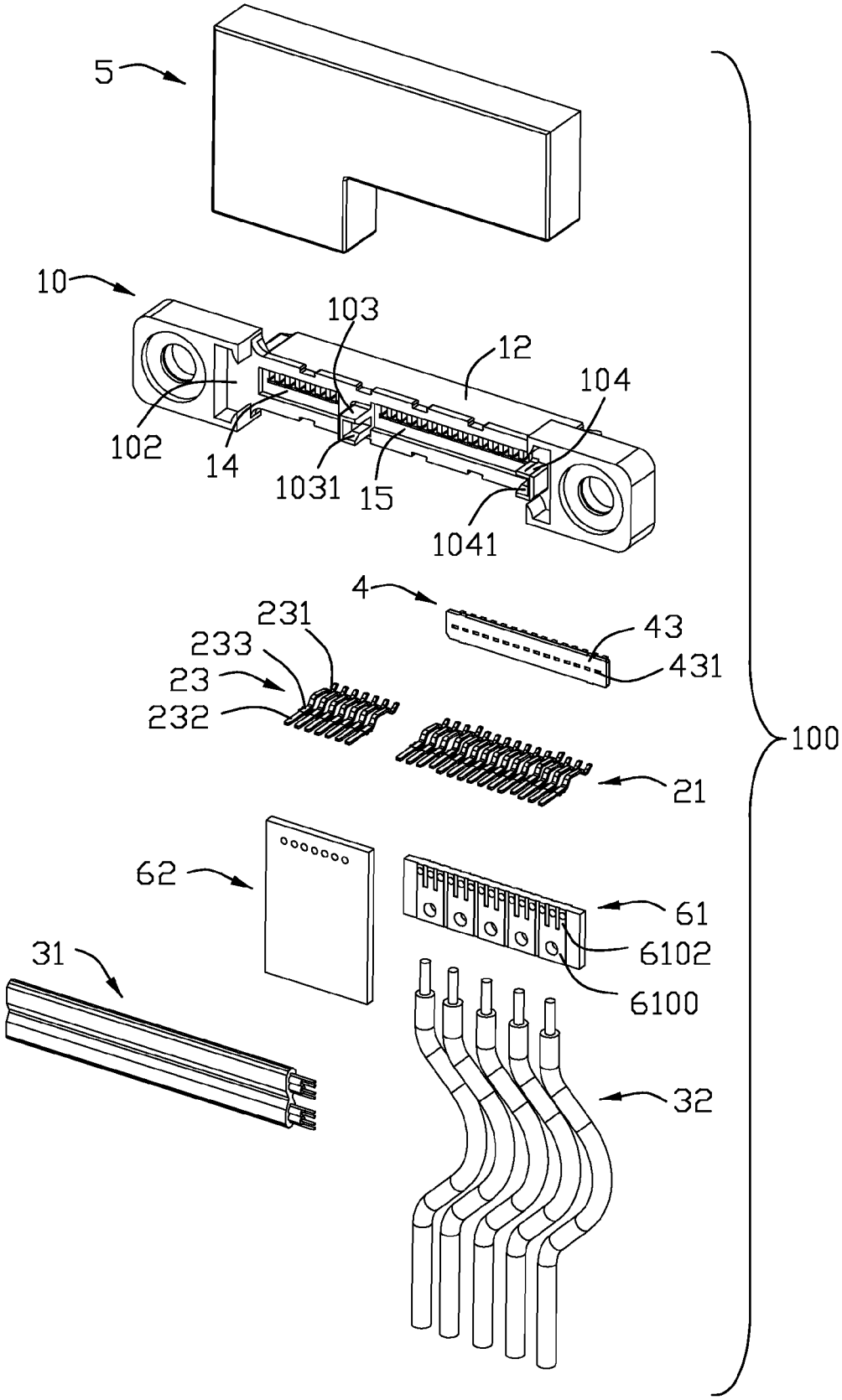
FIG. 3 is an exploded, perspective view of FIG. 1.

Reference will now be made to the drawing figures to describe the present invention in detail.

Figure 4:
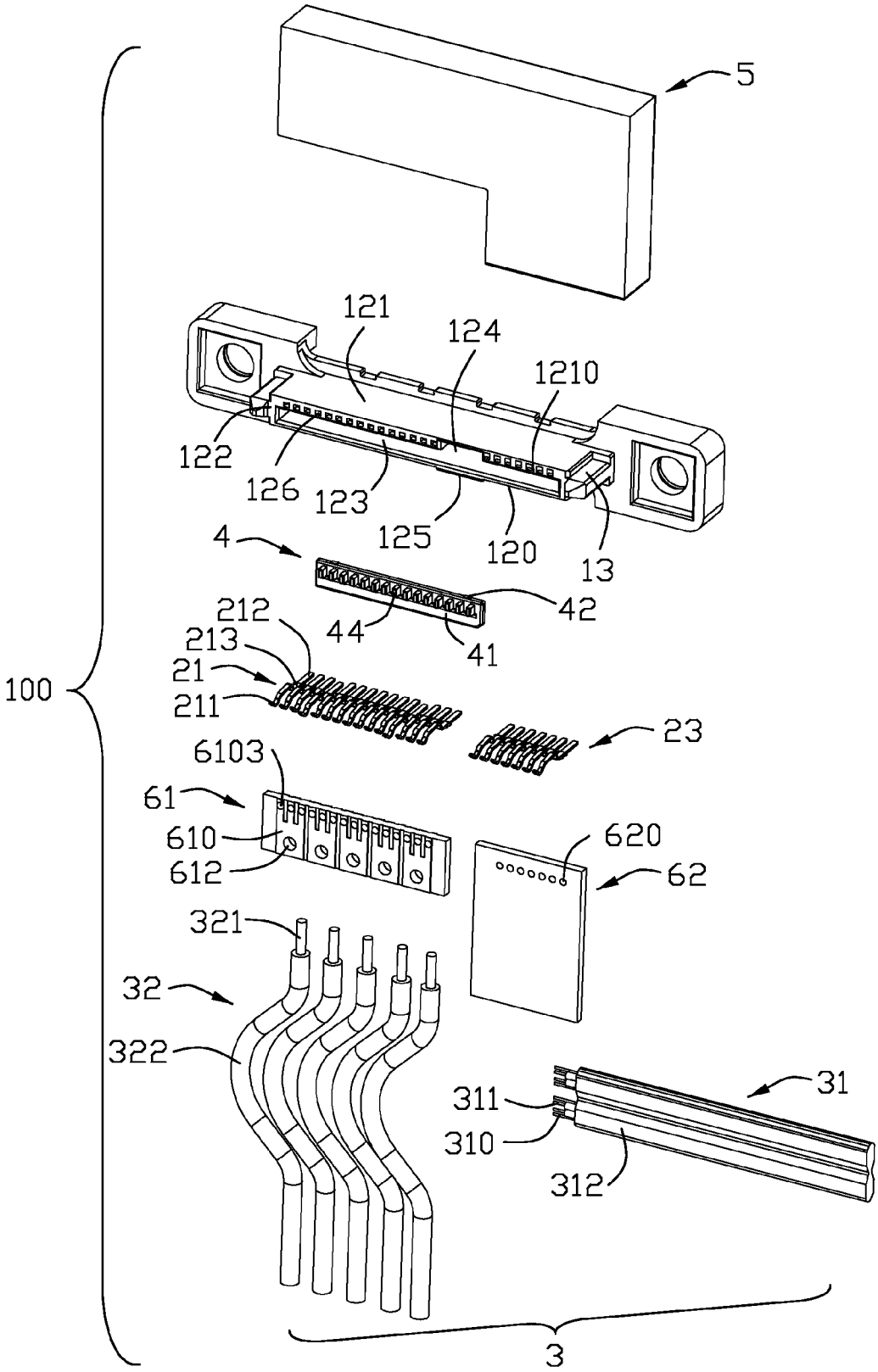
FIG. 4 is a view similar to FIG. 3, but viewed from a different aspect.
Figure 5:
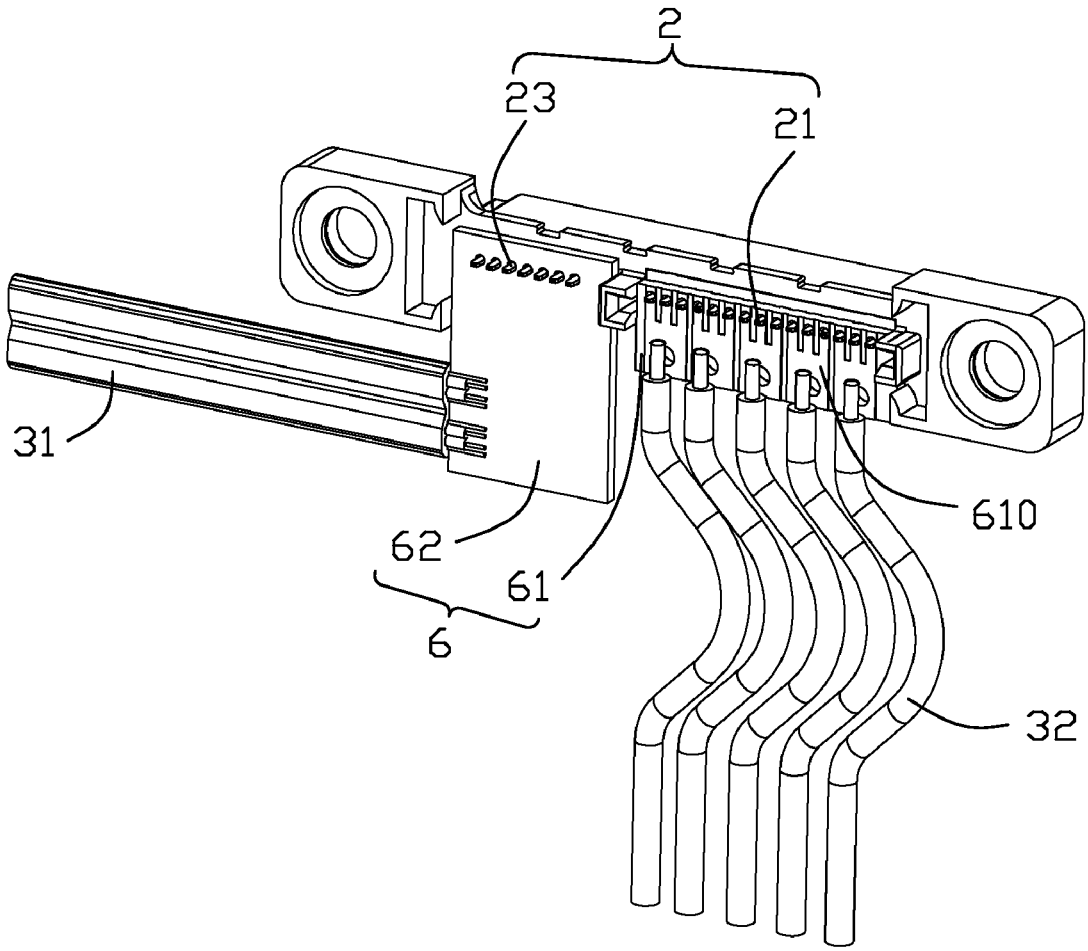
FIG. 5 is a partially assembled view of FIG. 1.
Figure 6:
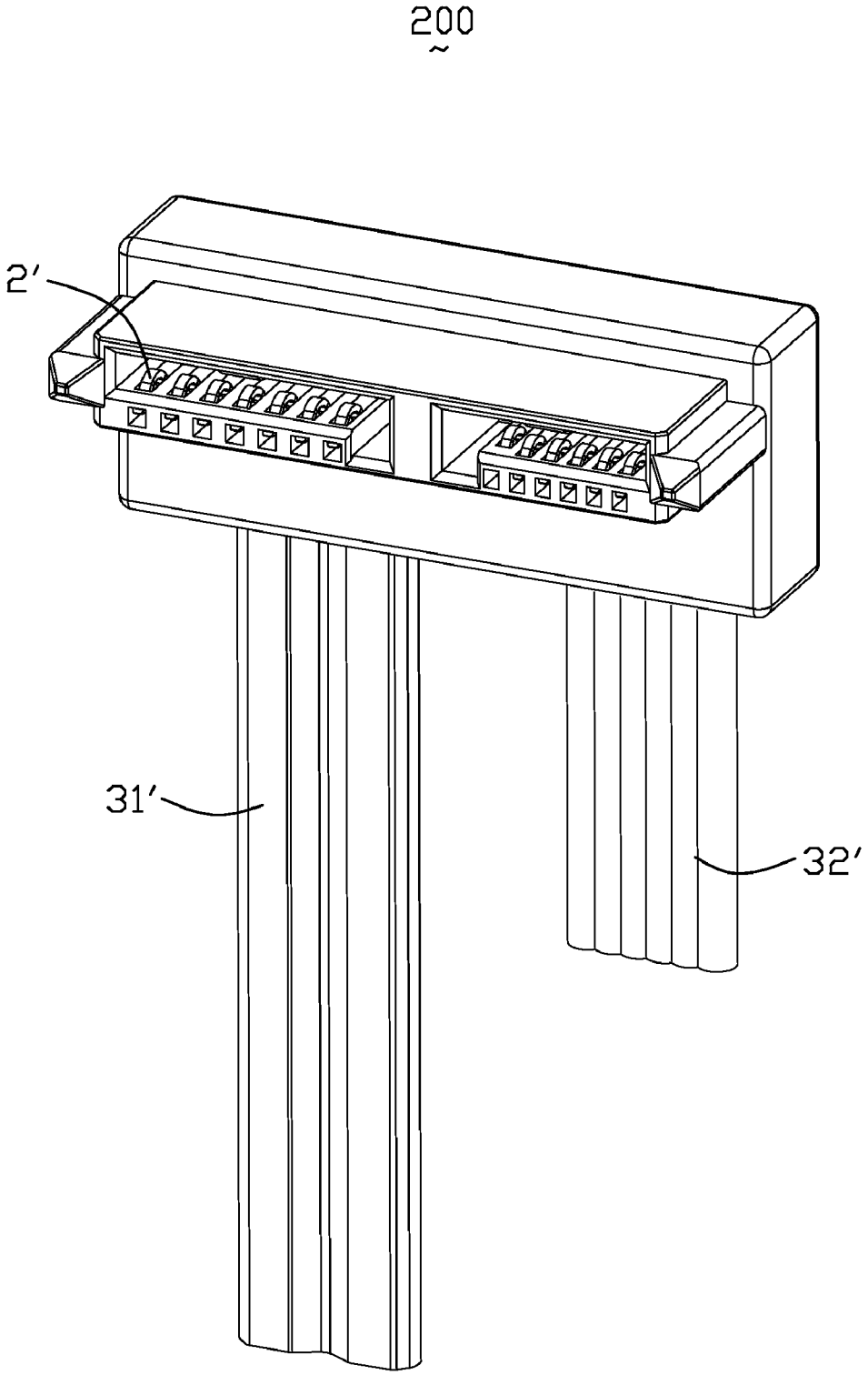
FIG. 6 is an assembled, perspective view of a plug connector of the second embodiment in accordance with the present invention.
Figure 7:
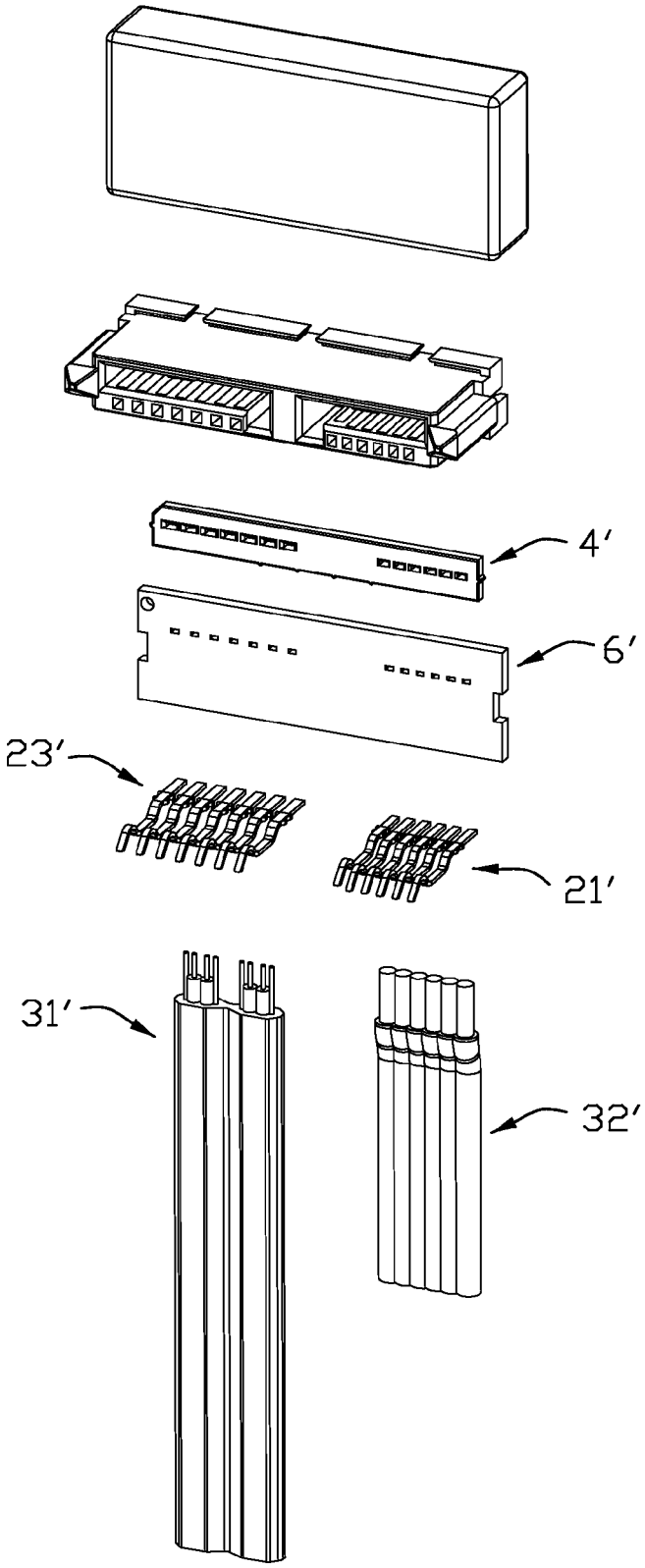
FIG. 7 is an exploded, perspective view of FIG. 6.
Figure 8:
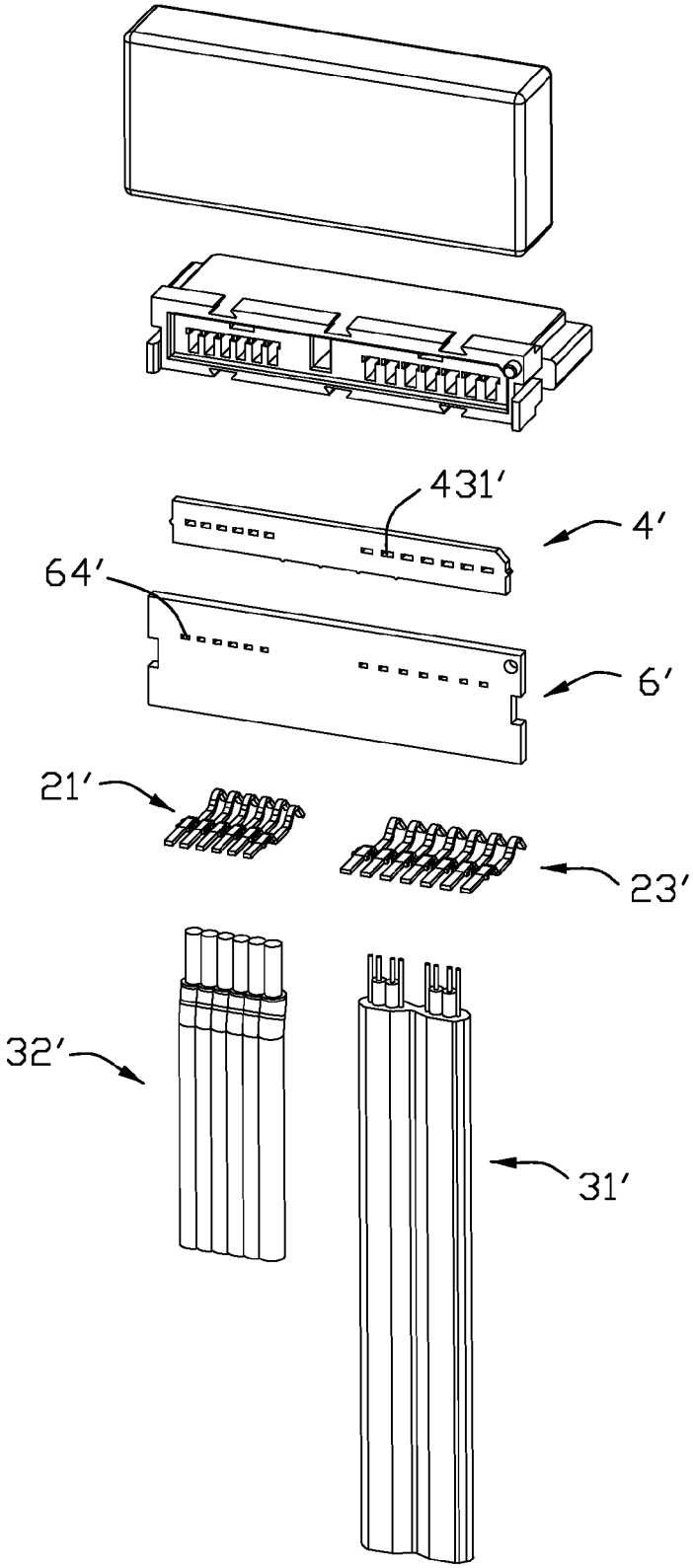
FIG. 8 is a view similar to FIG. 7, but viewed from a different aspect.
Figure 9:
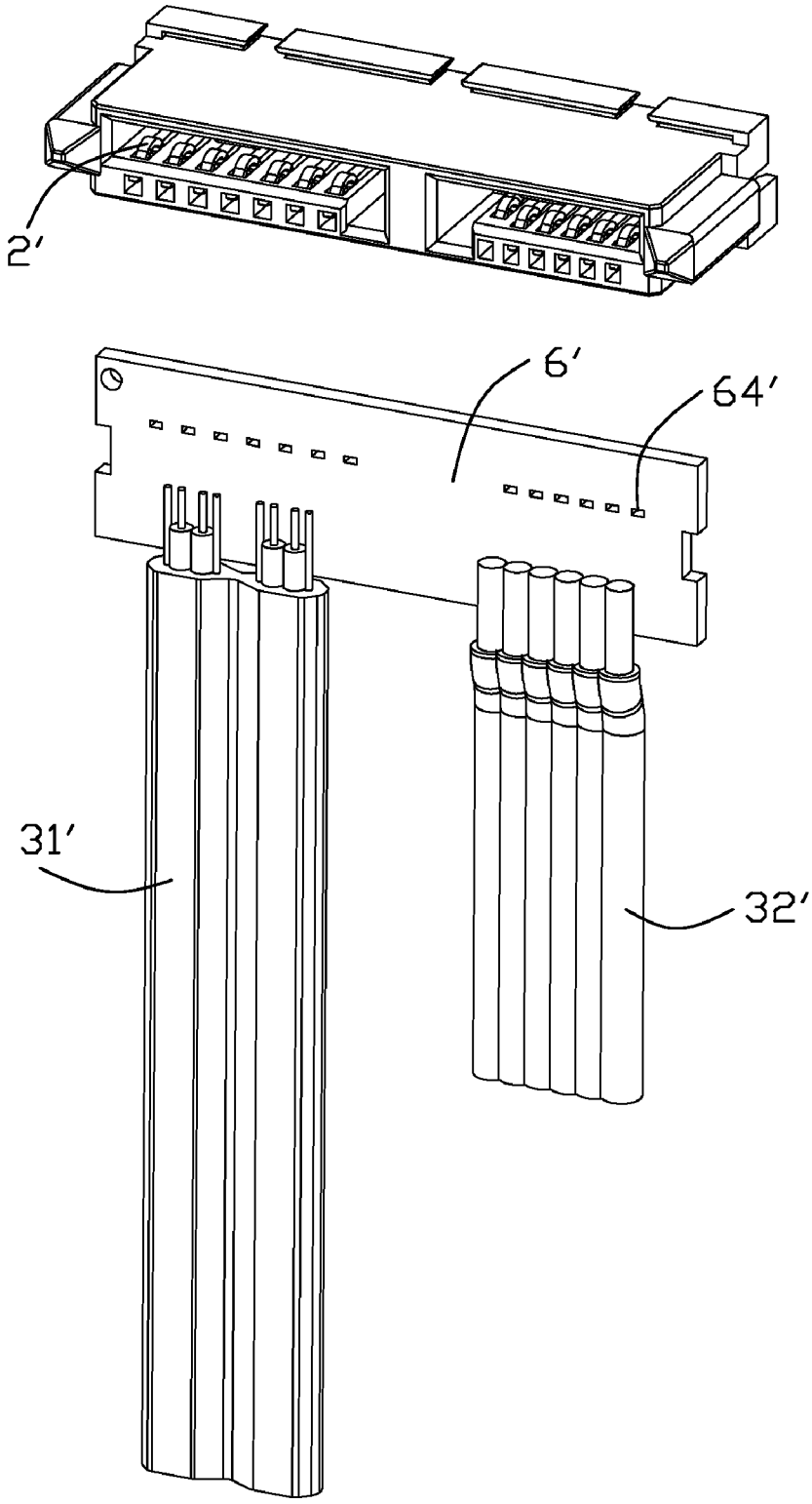
FIG. 9 is a partially assembled view of FIG. 8.
Figure 10:
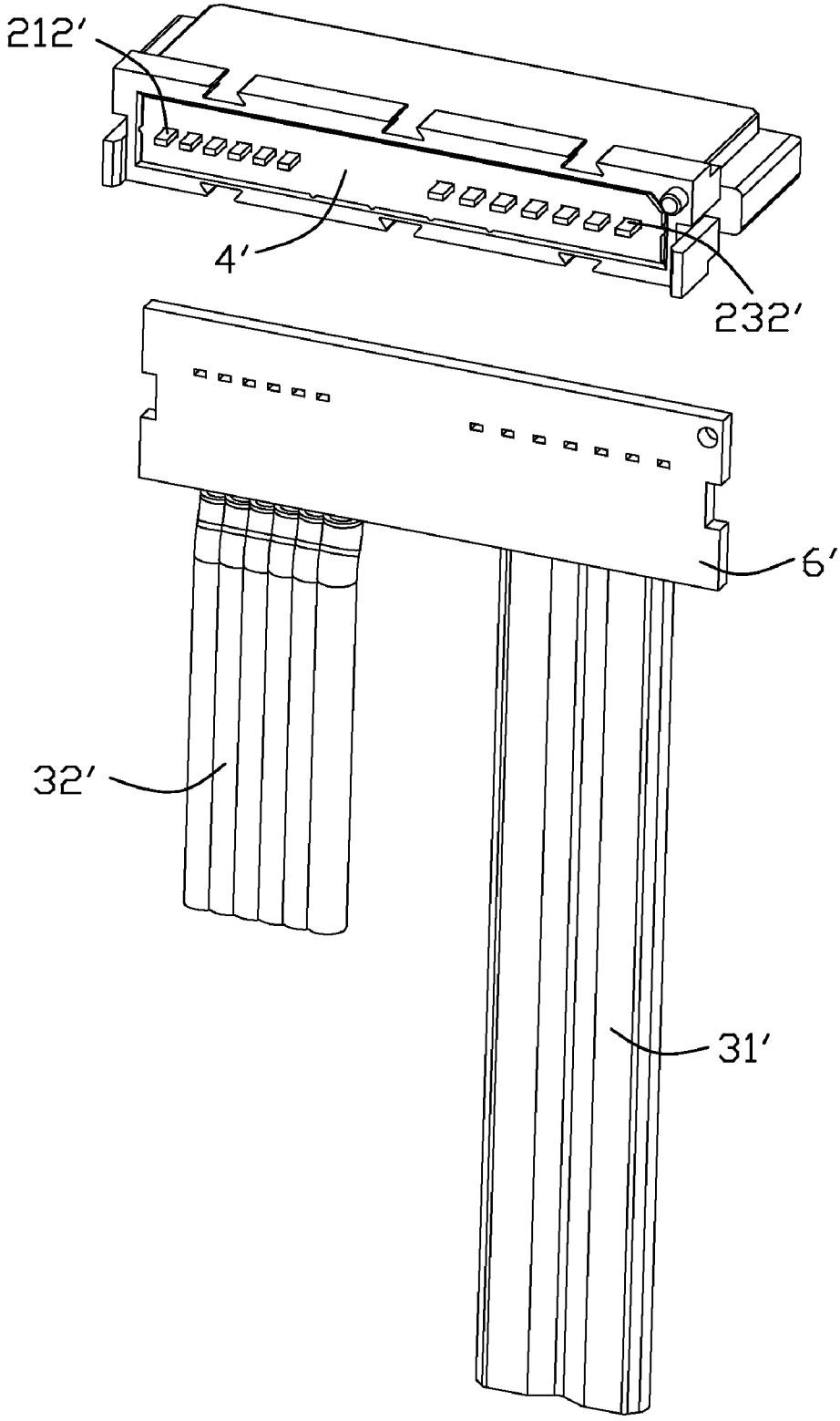
FIG. 10 is a view similar to FIG. 9, but viewed from a different aspect.

Referring to FIG. 1 and FIG. 4, a plug connector 100 of the first embodiment in accordance with the present invention comprises an insulative housing 1, a plurality of contacts 2 housed in the insulative housing 1, a plurality of wires 3 terminated to the contacts 2, a spacer 4 assembled to the insulative housing 1, a circuit board 6 positioned behind the spacer 4 and electrically connecting with the contacts 2 and the wires 3, and a cover 5 over-molded with the insulative housing 1.

Referring to FIGS. 1-5, the insulative housing 1 comprises an elongated base portion 10 and a mating portion 12 extending forwardly from a center of the base portion 10 along a mating direction of the plug connector 100, that is the first direction. The base portion 10 defines a first opening 14 and a second opening 15 recessed forwardly from a rear surface 102 thereof. A first leading portion 103 and a second leading portion 104 are protruding rearwards from the rear surface 102 of the base portion 10, a pair of leading slots 1031, 1041 are defined in the corresponding leading portion 103, 104 and face toward each other, the first leading portion 103 is located between the first opening 14 and the second opening 15. The mating portion 12 comprises a first sidewall 120, a second sidewall 121 and a pair of opposed laterally extending end walls 122. The four walls together define a continuous central receiving cavity 123. The first opening 14 and the second opening 15 are corresponding to a first mating area and a second area of the mating portion 12.

A pair of guiding parts 13 extending forwardly from the base portion 10 are respectively arranged at opposite sides of the end walls 122. The second sidewall 121 defines a recess 124 recessed from an inner face 1210 thereof and communicating with the middle portion of the receiving cavity 123. The first sidewall 120 forms an expansion portion 125 on an exterior face thereof and aligned with the recess 124 along a vertical direction. The recess 124 divides the second sidewall 121 into two different-dimension parts along elongated direction. The thickness of the first sidewall 120 is smaller than that of the second sidewall 121. The second sidewall 121 defines a plurality of passageways 126, the passageways 126 penetrate through the insulative housing 1 along the mating direction.

The contacts 2 comprise a plurality of first and second contacts 21, 23 respectively received in the first passageways 126. The first contacts 21 are power contacts and include five sets of contact group each comprising three contacts, while, the second contacts 23 are signal contacts. The first contact 21 comprises a curved contacting portion 211, a tail portion 212 extending rearwardly and flatly, and a retention portion 213 connecting with the contacting portion 211 and the tail portion 212. A plurality of barbs (not numbered) is provided on opposite sides of the retention portion 213. The structure of the second contact 23 is same as that of the first contact 21, and also comprises a curved contacting portion 231, a tail portion 232 extending rearwardly and horizontally, and a retention portion 233 connecting with the contacting portion 231 and the tail portion 232. The pin count numbers of the first and second contacts 21, 23 are different, the first contacts 21 comprise 15 contacts and the second contacts 23 comprise 7 contacts.

The spacer 4 extends longitudinally and is substantially rectangular, the dimension thereof is substantially same as that of the second opening 15 of the insulative housing 1. The spacer 4 comprises a front surface 41 and an opposed rear surface 43. A pair of tubers 42 are arranged on top edge of the spacer 4. The spacer 4 forms a plurality of ribs 44 extending forwardly from the front surface 41 thereof and aligning with the passageways 126 of the insulative housing 1 for supporting the retention portion 213. The spacer 4 also defines a plurality through holes 431 aligning with corresponding ribs 44.

The wires 3 comprise a signal cable 31 and a plurality of second wires 32. The signal cable 31 consists of two groups, each group comprises a pair of signal conductors 311 for transmitting signals of differential pair and a pair of grounding conductors 310 located at outer sides of the pair of signal conductors 311. Each signal cable 31 comprises a plurality of conductors 310, 311 and an outer jacket 312, the front ends of the conductors 310, 311 are exposed beyond the outer jacket 312 and electrically connect with corresponding tail portions 232 of the second contacts 23. The signal cable 31 extends along a second direction vertical to the first direction. The power wires 32 have five single-ended wires. Each power wire comprises at least one conductor 321 and an outer jacket 322, the conductors 321 are electrically connected with corresponding tail portions 212 of the first contacts 21. The signal cable 31 is arranged at one side of the base portion 10 and extends along the second direction perpendicular to the first mating direction of the mating portion 12 when soldered on the circuit board 6. The power wires 32 extend along the third direction perpendicular to the first mating direction of the mating portion 12. In the first embodiment of the present invention, the third direction is also perpendicular to the second direction. In other embodiments, the third direction is angled with the second direction discretionarily.

The circuit board 6 comprises a first board 61 transmitting power and a second board 62 transmitting signal. In other embodiment of the present invention, the circuit board 6 also can be of one-piece configuration divided into two segments connected with signal and power wires respectively. The first board 61 comprises five sets of conductive traces 610 and a plurality of through holes 612. Each set of conductive traces 610 is of fork-shape and comprises a base section 6100 electrically connecting with the power wires 32 and three fingers 6102 extending from the base section 6100 to electrically connect with corresponding contacts 2. Each finger 6102 defines a small hole 6103. The through holes 612 penetrate through the first board 6 and each through hole 612 is plated with conductive material for electrically connect the power wires 32 with corresponding conductive traces 610 when the power wires 32 soldered within the through holes 612. The second board 62 defines a plurality of holes 620 connecting with the second contacts 23. The second board 62 comprises a first connecting area along a horizontal direction and a second connecting area along a vertical direction, the holes 620 are in the first connecting area, and the signal wires 31 are connected with the second board 62 on the second connecting area.

Please refer to FIGS. 1-5, the first and second contacts 21, 23 are respectively assembled to the insulative housing 1 along the mating direction and received in the passageways 126 of the insulative housing 1. The contacting portions 211, 231 of the contacts 21, 23 are exposed in the central receiving cavity 123 and located in the first and second mating area respectively. The retention portions 213, 233 interferentially engage with the spacer 4 and passageways 126, and the tail portions 212, 232 extend beyond the rear surface 102 of the insulative housing 1. The spacer 4 is assembled to the rear surface 102 of the insulative housing 1 along the first and second leading portion 103, 104, while the first board 61 is disposed behind the rear surface 43 of the spacer 4. The ribs 44 are inserted into the passageways 126 to connect the spacer 4 with the insulative housing 2 and seal the rear ends of the passageways 126. The spacer 4 is received in the second opening 15 with the tubers 42 interferentially engaging with inner surfaces of the second opening 15. The tail portions 212 of the first contacts 21 protrude through the through holes 431 of the spacer 4 and then extend through the hole 6103 of the first board 61, parts thereof beyond the first board 61 extend along the mating direction and aren't bent necessarily. The second board 62 is disposed behind the first opening 14, the tail portions 232 of the second contacts 23 are inserted into the holes 620 of the second board 62 and soldered therein, parts of the signal contacts 23 beyond the second board 62 also extend along the mating direction and aren't bent necessarily.

The three tail portions 212 of each set of first contacts 21 respectively solder with three fingers 6102 of the same conductive trace 610 of the first board 61 to realize the multi-to-one electrical connection manner. The conductors 321 of the power wires 32 are soldered in the through holes 612 and electrically connected with the first contacts 21. The signal cable 31 is soldered on a surface of the second board 62 flatly, or soldered in holes of the second board 62.

The cover 5 is of L-shape and is overmolded with the base portion 10, the solder area between the contacts 2 and the wires 3, the spacer 4 and the circuit board 6. Thus, the electrical connection between the contacts 2 and the wires 3 is enhanced. When molding the cover 5, the ribs 44 seal the passageways 126 from the rear surface 102 of the insulative housing 1, melted material of the cover 5 cannot flow into the insulative housing 1. While, since the base portion 10 is enclosed by the cover 5, the first and second leading portion 103, 104 enclosed by the melted material, and the leading slots 1031, 1041 are filled by the material of the cover 5, thus enhancing the connection between the insulative housing 1 and the cover 5. The second passageways (not shown) of the expansion portion 125 are capable of receive corresponding contacts (not shown) to electrically match with SAS interface complementary connector or SATA interface complementary connector. In alternative embodiments, the second passageways also can be omitted, and the remained expansion portion 125 can enhance the intensity of the first sidewall 120 and matches with SATA interface complementary connector. After molding the cover 5, the signal cable 31 extends from a horizontal portion of the cover 5 and out of the plug connector 100 laterally, while the power wires 32 extend from a vertical portion of the cover 5 along the direction perpendicular to the mating direction.

Please refer to FIGS. 6-10, a plug connector 200 in accordance with the second embodiment of the present invention have most elements and same structures of the plug connector 100 in accordance of the first embodiment, the signal contacts 23' and the signal cable 31' aren't bent and the signal cable 31' can extend along the direction vertical to the mating direction. Compared with the plug connector 100, the tail portions of the contacts 2' extend along the mating direction horizontally, the tail portions 212', 232' penetrate through the through holes 431' of the spacer 4', and then insert into the through holes 64' of the same circuit board 6'. The tail portions 212', 232' are soldered in corresponding through holes 64'. The signal cable 31 ' and power wires 32' are arranged and soldered on front side of the circuit board 6' to electrically connect with the contacts 2'. The signal cable 31' and the power wires 32' extend along a direction perpendicular to the first mating direction of the plug connector 200', and keep parallel to each other.

As the plug connector 200' has most elements and same structures of the plug connector 100, and the assembling process therebetween is similar and can be omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector, comprising:

an insulative housing comprising a base portion and a mating portion extending from the base portion in a first mating direction;

a plurality of contacts received in the insulative housing and comprising a number of signal contacts and a number of power contacts;

a circuit board with a plurality of through holes therein, the signal contacts soldered with the circuit board; and a plurality of wires comprising a plurality of signal wires and a plurality of power wires respectively electrically connecting with the contacts; wherein the signal wires are flatly soldered on the circuit board, the power wires are soldered with the contacts directly or electrically connected with the contacts by the circuit board, the signal wires are arranged to extend laterally along a second direction perpendicular to a first mating direction, and the power wires are arranged to extend along a third direction perpendicular to the second direction.

2. The plug connector as claimed in claim 1, wherein the circuit board comprises a first connecting area along a horizontal direction and a second connecting area along a vertical direction, the signal contacts are connected with the circuit board on the first connecting area, and the signal wires are connected with the circuit board on the second connecting area.

3. The plug connector as claimed in claim 1, wherein the circuit board is of two-piece configuration, and comprises two independent parts, and one part is soldering with the signal wires, and the other is soldering with the power wires.

4. The plug connector as claimed in claim 1, wherein the circuit board is of one-piece configuration, and divided into two segments connected with the signal wires and the power wires respectively.

5. The plug connector as claimed in claim 1, wherein the signal contacts penetrate the through holes of the circuit board and the end beyond the circuit board extend along the first mating direction.

6. The plug connector as claimed in claim 5, wherein the power contacts penetrate through the circuit board as the signal contacts.

7. The plug connector as claimed in claim 1, wherein the signal wires comprise two groups, and wherein each group comprises a pair of signal conductors and a pair of grounding conductors located at opposite outer sides of the pair of signal conductors.

8. The plug connector as claimed in claim 1, further comprising a cover, and wherein the cover is overmolded with the base portion of the insulative housing and the connection area between the contacts and the wires.

9. The plug connector as claimed in claim 8, wherein the cover is of L-shape, and wherein the power wires extend downwardly from a vertical portion of the cover, while the signal wires extend laterally from a horizontal portion of the cover.

10. The plug connector as claimed in claim 5, wherein the base portion defines a first opening and a second opening.

11. The plug connector as claimed in claim 10, wherein the circuit board comprises a first board and a second board, the second board is disposed behind the first opening with the first board disposed behind the second opening.

12. The plug connector as claimed in claim 10, wherein a pair of leading portions protrude from a rear surface of the base portion rearwardly, and one leading portion is located between the first opening and the second opening.

13. The plug connector as claimed in claim 5, wherein the circuit board comprises a plurality of conductive traces electrically connecting with the power wires and the contacts, the conductive trace is of fork-shape and comprises a base section electrically connecting with the power wires and at least one finger electrically connecting with corresponding contact.

14. The plug connector as claimed in claim 13, wherein the power contacts are respectively soldered with fingers of corresponding conductive traces of the circuit board.

* * * * *